US006361681B1

(12) United States Patent
de Nora et al.

(10) Patent No.: US 6,361,681 B1
(45) Date of Patent: Mar. 26, 2002

(54) SLURRY FOR COATING NON-CARBON METAL-BASED ANODES FOR METAL PRODUCTION CELLS

(75) Inventors: Vittorio de Nora, Nassau (BS); Jean-Jacques Duruz, Geneva (CH)

(73) Assignee: Moltech Invent S.A. Luxembourg (LU)

( * ) Notice: Subject to any disclaimer, the term of this patent is extended or adjusted under 35 U.S.C. 154(b) by 0 days.

(21) Appl. No.: 09/616,319

(22) Filed: Jul. 15, 2000

Related U.S. Application Data

(63) Continuation of application No. PCT/IB99/00081, filed on Jan. 19, 1999.

(51) Int. Cl.[7] ..... C25C 3/08

(52) U.S. Cl. ..... 205/387; 205/384; 204/290.01; 204/243.1; 204/247.3; 427/126.3; 427/372.2; 427/376.2; 427/383.7; 427/419.2; 427/419.3; 106/286.1

(58) Field of Search ..... 427/126.3, 372.2, 427/376.2, 383.7, 419.2, 419.3; 205/384, 387; 106/286.1; 204/290.01, 243.1, 247.3

(56) References Cited

U.S. PATENT DOCUMENTS 6,077,415 A * 6/2000 Duruz et al. ..... 204/243.1
6,113,758 A * 9/2000 de Nora et al. ..... 204/290.01
6,139,704 A * 10/2000 de Nora et al. ..... 204/247.3

* cited by examiner

*Primary Examiner*—Bruce F. Bell
(74) *Attorney, Agent, or Firm*—Jayadeep R. Deshmukh

(57) ABSTRACT

A method of coating an electronically conductive and heat resistant substrate of an anode of a cell for the electrowinning of metals, in particular a cell for the electrowinning of aluminium, to protect and make the surface of the anode active for the oxidation of the oxygen ions present in the electrolyte. The method comprises applying onto the substrate a slurry comprising at least one oxide or oxide precursor as a non-dispersed but suspended particulate in a colloidal and/or inorganic polymeric carrier. The applied-slurry is then solidified and made adherent to the substrate upon heat treatment to form an adherent, protective, predominantly oxide-containing coating. The colloidal and/or inorganic polymeric carrier may comprise at least one of alumina, ceria, lithia, magnesia, silica, thoria, yttria, zirconia, tin oxide and zinc oxide. The oxide of the coating may be a chromite or a ferrite, such as a ferrite selected from cobalt, copper, manganese, nickel and zinc.

56 Claims, No Drawings

SLURRY FOR COATING NON-CARBON METAL-BASED ANODES FOR METAL PRODUCTION CELLS

This application is a continuation of co-pending international application designating the USA, PCT/IB99/00081, filed on Jan. 19, 1999.

FIELD OF THE INVENTION

This invention relates to a slurry for coating anodes for use in cells for the electrowinning of metals from their oxides dissolved in molten salts, and to methods for their fabrication and reconditioning, as well as aluminium electrowinning cells containing coated anodes and their use to produce aluminium.

BACKGROUND ART

The production of metals by the electrolysis of their oxides is usually carried out in very chemically aggressive environments. Therefore, the materials used for the manufacture of components of production cells must be resistant to attack by the environment of such cell. Anodes of cells for the production of metals by the electrolysis of their oxides dissolved in molten salts need to be resistant to attack by the electrolyte and by the oxygen which is anodically produced during electrolysis.

Unfortunately, for the dissolution of the raw material a highly aggressive electrolyte, such as a fluoride-based electrolyte is required.

The surface of the anode must be electrochemically active, substantially insoluble in the electrolyte and resistant to attacks by the nascent monoatomic oxygen and by the subsequently formed molecular oxygen gas which are anodically produced. Since monoatomic oxygen is far more aggressive than biatomic molecular gaseous oxygen, the constituents of the active surface of the anode should contain electro-catalytic materials for the reaction which forms molecular oxygen from the monoatomic oxygen to reduce monatomic oxygen attack.

The materials having the greatest resistance to oxidation are metal oxides which are all to some extent soluble in cryolite. Oxides are also poorly electrically conductive, therefore, to avoid substantial ohmic losses and high cell voltages, the use of oxides should be minimal in the manufacture of anodes. Whenever possible, a good conductive material should be utilised for the anode core, whereas the surface of the anode is preferably made of an oxide having a high electrocatalytic activity.

In the field of aluminium production, it has been described in U.S. Pat. Nos. 5,069,771, 4,960,494 and 4,956,068 (all Nyguen/Lazouni/Doan), and U.S. Pat. No. 5,510,008 (Sekhar/Liu/Duruz) that a metal core could be protected by barrier layers and/or by oxidised metals but these results have not as yet been commercially and industrially applied.

OBJECT OF THE INVENTION

An object of the invention is to provide a method for coating an anode for metal electrowinning cells, in particular aluminium electrowinning cells, which substantially reduces the consumption of the active anode surface that is attacked by nascent monoatomic oxygen by enhancing the reaction of nascent oxygen to gaseous molecular gaseous oxygen.

Another object of the invention is to provide a slurry for coating anodes for metal electrowinning cells, in particular aluminium electrowinning cells, which provides a coating with high electrolytic activity, a long life and which can be re-coated onto the anode as soon as such activity decreases or when the coating is worn out.

A major object of the invention is to provide an anode for metal electrowinning cells, in particular aluminium electrowinning cells, which has no carbon so as to eliminate carbon-generated pollution and reduce the cell voltage and the high cost of cell operation.

SUMMARY OF THE INVENTION

The present invention concerns a method of applying a slurry onto a conductive, heat resistant anode substrate to form an oxide coating on those parts of the substrate which are exposed to oxidising or corrosive cell environments.

The invention in particular relates to a method of coating an electronically conductive and heat resistant substrate of a non-carbon metal-based anode of a cell for the electrowinning of metals from their oxides dissolved in molten salt, to protect and make the surface of the anode substrate active for the oxidation of the oxygen ions present in the electrolyte. The method comprises applying onto the substrate a slurry comprising at least one oxide or a precursor thereof as a non-dispersed but suspended particulate in a colloidal and/or inorganic polymeric carrier, the slurry is then solidified and made adherent to the substrate upon heat treatment to form an adherent, protective, predominantly oxide-containing coating.

An oxide may be present in the oxide-containing coating as such, or in a multi-compound mixed oxide and/or in a solid solution of oxides. The oxide may be in the form of a simple, double and/or multiple oxide, and/or in the form of a stoichiometric or non-stoichiometric oxide.

A typical application for this method is the coating of anodes for the electrowinning of aluminium by the electrolysis of alumina dissolved in a molten fluoride-containing electrolyte, such as a cryolite-based electrolyte or cryolite.

The colloidal and/or inorganic polymeric carrier may be selected from alumina, ceria, lithia, magnesia, silica, thoria, yttria, zirconia, tin oxide, zinc oxide and mixtures thereof.

Advantageously, the colloidal and/or inorganic polymeric carrier forms upon heat treatment the same chemical compound as the non-dispersed particulate.

The oxides which may be used as a non-dispersed particulate and/or as a carrier may be in the form of spinels and/or perovskites or precursors thereof. Spinels may be doped, non-stoichiometric and/or partially substituted spinels, the doped spinels comprising dopants selected from the group consisting of $Ti^{4+}$, $Zr^{4+}$, $Sn^{4+}$, $Fe^{4+}$, $Hf^{4+}$, $Mn^{4+}$, $Fe^{3+}$, $Ni^{3+}$, $Co^{3+}$, $Al^{3+}$, $Cr^{3+}$, $Fe^{2+}$, $Ni^{2+}$, $Co^{2+}$, $Mg^{2+}$, $Mn^{2+}$, $Cu^{2+}$, $Zn^{2+}$ and $Li^{+}$.

The spinels may comprise a ferrite which can be selected from cobalt, copper, chromium, manganese, nickel and zinc ferrite, and mixtures and precursors thereof. The ferrites may also be doped with at least one oxide selected from chromium, titanium, tin, zinc and zirconium. Nickel-ferrite is a preferred compound for an electrochemically active coating for its high chemical resistance and may be present as such or partially substituted with $Fe^{2+}$.

Alternatively, the spinels may also comprise a chromite which can be selected from iron, cobalt, copper, manganese, beryllium, calcium, strontium, barium, yttrium, magnesium, nickel and zinc chromite, and mixtures and precursors thereof.

The slurry advantageously comprises one or more electrocatalysts or a precursor thereof, however such a constituent is not always necessary. When an electrocatalyst is used, it may be advantageously selected from iridium, palladium, platinum, rhodium, ruthenium, silicon, tin, zinc, Mischmetal oxides and metals of the Lanthanide series, and mixtures and compounds thereof.

For the formation of the coating onto the substrate, the oxide constituents of the slurry may react among themselves. Alternatively the constituents of the slurry may react with constituents of the electronically conductive and heat resistant substrate. However, a reaction is not always necessary for the formation of the coating from the slurry.

The slurry may be applied onto the substrate by conventional techniques such as brushing, spraying dipping, electrodeposition or by using rollers.

The substrate can be chosen among metals, alloys, intermetallics, cermets, and conductive ceramics. It may for instance comprise at least one of chromium, cobalt, hafnium, iron, molybdenum, nickel, copper, niobium, platinum, silicon, tantalum, titanium, tungsten, vanadium, yttrium and zirconium, and their combinations and compounds.

The substrates may advantageously have a self-healing effect, i.e. when exposed to electrolyte the substrate passivates under the effect of the electrical current and becomes substantially inert to the electrolyte.

The adherence of the coating on the substrate may be enhanced by applying onto the substrate a pre-coat before applying the slurry. Several methods are known to obtain an oxide pre-coat on a metal substrate, e.g. heating in air for prolonged periods at high temperatures (>1000° C.).

However, a preferred pre-coat can be formed by applying a metal oxide in a colloidal or polymeric solution onto a clean metal substrate, drying and heat-treating the pre-coat at 500° C. Oxides for the pre-coat may be selected from $SiO_2$, $Al_2O_3$, $ThO_2$, $ZrO_2$, $SnO_2$, $TiO_2$ and $CeO_2$. Preferably the colloid/polymer contains cerium oxide having a crystallite size of about 5 to 10 nanometer and a $NO_3^-/CeO_2$ mole ratio of approximately 0.25, which can be prepared by following the teachings of U.S. Pat. No. 4,356,106 (Woodhead/Raw).

The pre-coat can be applied from a colloidal dispersion having a concentration between 25 and 250 g/l. Conventional techniques such as dipping, brushing or spraying can be used prior to drying and/or heat-treating the pre-coat.

The invention also relates to an anode coating slurry for coating an electronically conductive and heat resistant substrate of a non-carbon metal-based anode for the electrowinning of metals from their oxides dissolved in molten salts, to form an adherent, protective, predominantly oxide-containing coating after heat treatment and to make the surface of the anode active for the oxidation of the oxygen ions present in the electrolyte. The slurry comprises at least one oxide or oxide precursor as a non-dispersed but suspended or suspendable particulate in a colloidal and/or inorganic polymeric carrier.

This method may also be applied for reconditioning a non-carbon metal-based anode with a slurry as described hereabove, the active coating of which anode has become non-active or worn out. The method comprises clearing and restoring the surface of the conductive substrate before applying the slurry onto the substrate as described hereabove.

Another aspect of the invention is an anode of a cell for the electrowinning of a metal, in particular of an aluminium electrowinning cell, comprising an electronically conductive substrate and a protective electrochemically active coating obtained from a slurry as described hereabove.

A further aspect of the invention is a cell for the production of a metal by the electrolysis of its oxide dissolved in a molten salt, in particular for the electrowinning of aluminium or a lanthanide such as neodymium, having at least one anode comprising an electronically conductive substrate and a protective electrochemically active coating obtained from a slurry as described hereabove.

An aluminium electrowinning cell may advantageously comprise at least one aluminium-wettable cathode. The cell may be in a drained configuration by having at least one drained cathode on which aluminium is produced and from which aluminium continuously drains. The cell may be of monopolar, multi-monopolar or bipolar configuration. A bipolar cell may comprise the anodes as described above as a terminal anode or as the anode part of a bipolar electrode.

Preferably, the aluminium electrowinning cell comprises means to improve the circulation of the electrolyte between the anodes and facing cathodes and/or means to facilitate dissolution of alumina in the electrolyte. Such means can for instance be provided by the geometry of the cell as described in co-pending application PCT/IB98/00161 (de Nora/Duruz) or by periodically moving the anodes as described in co-pending application PCT/IB98/00162 (Duruz/Bellò).

The aluminium electrowinning cell may be operated with the electrolyte at conventional temperatures, such as 950 to 970° C., or at reduced temperatures as low as 750° C.

Yet another aspect of the invention is a method of electrowinning aluminium in a cell comprising at least one coated non-carbon metal-based anode as described hereabove, the method comprising dissolving alumina in the electrolyte and then electrolysing the dissolved alumina to produce aluminium.

The slurry as described hereabove can be used for coating a non-carbon metal-based anode for the production of aluminium in a cell for the electrowinning of aluminium by the electrolysis of alumina dissolved in a fluoride-containing electrolyte, on which anode oxygen ions in the electrolyte are oxidised and released as biatomic molecular gaseous oxygen by the electrochemically active anode slurry-obtained coating.

DETAILED DESCRIPTION

The invention will be further described in the following Examples:

EXAMPLE 1

A polymeric slurry was prepared from: a non-dispersable but suspendable particulate consisting of a nickel-ferrite powder and a nickel aluminate ($NiOAl_2O_3$) precursor material acting as a polymeric carrier and binder for the nickel ferrite powder. The nickel-ferrite powder was specially prepared; however, commercially-available products could also have been used. The precursor $NiOAl_2O_3$ materials, solution and gel powder reacted to form the spinel $NiAl_2O_4$ at <1000° C.

When applied to a suitably prepared substrate such as nickel, this slurry produced an oxide coating made from the pre-formed or the in-situ formed nickel ferrite which adhered well onto the substrate and formed a coherent coating when dried and heated. The slurry could be applied by a simple technique such as brushing or dipping to give a coating of pre-determined thickness.

EXAMPLE 2

A carrier consisting of a nickel aluminate polymeric solution containing a non-dispersed but suspended particulate of nickel aluminate was made by heating 75 g of $Al(NO_3)_3.9\ H_2O$ (0.2 moles Al) at 80° C. to give a concentrated solution which readily dissolved 12 g of $NiCO_3$ (0.1 moles). The viscous solution (50 ml) contained 200 g/l $Al_2O_3$ and 160 g/l NiO (total oxide, >350 g/l).

This nickel-rich polymeric concentrated anion deficient solution was compatible with commercially-available alumina sols e.g. NYACOL™.

A stoichiometrically accurate $NiO.Al_2O_3$ mixture was prepared by adding 5 ml of the anion deficient solution to 2.0 ml of a 150 g/l alumina sol; this mixture was stable to gelling and could be applied to smooth metal and ceramic surfaces by a dip-coating technique. When heated to 450–500° C., X-ray diffraction showed nickel-aluminate had formed in the coating.

Other non-dispersable particulate than nickel aluminate could be suspended in the anion-deficient nickel aluminate precursor solution and applied as coatings which when heat-treated would form nickel-aluminate containing the added oxides.

EXAMPLE 3

A colloidal solution containing a metal ferrite precursor (as required for $NiONiFe_2O_4$) was prepared by mixing 20.7 g $Ni(NO_3)_2.6\ H_2O$ (5.17 g NiO) with 18.4 g $Fe(NO_3)_3.9\ H_2O$ (4.8 g $Fe_2O_3$) and dissolving the salts in water to a volume of 30 ml. The solution was stable to viscosity changes and to precipitation when aged for several days at 20° C.

An organic solvent such as PRIMENE™ JMT ($R_3CNH_2$ molecular weight ~350) is immiscible with water and extracts nitric acid from acid and metal nitrate salt solutions. An amount of 75 ml of the PRIMENE™ JMT (2.3 M) diluted with an inert hydrocarbon solvent was mixed with 10 ml of the colloidal nickel-ferrite precursor solution. Within a few minutes the spherical droplets of feed were converted to a mixed oxide gel; they were filtered off, washed with acetone and dried to a free-flowing powder. When the gel was heated in air, nickel-ferrite formed at <800° C. and the powder could be used as a non-dispersable but suspended particulate in colloidal and/or inorganic polymeric slurries as described in Example 1 or 2. Commercially-available nickel-ferrite powder could also have been used.

EXAMPLE 4

An amount of 5 g of $NiCO_3$ was dissolved in a solution containing 35 g $Fe(NO_3)_3.9\ H_2O$ to give a mixture (40 ml) having the composition required for the formation of $NiFe2O_4$. The solution was converted to gel particles by solvent extracting the nitrate with PRIMENE™ JMT as described in Example 3. The nickel-ferrite precursor gel was calcined in air to give a non-dispersable but suspended particulate in the form of a nickel-ferrite powder, which could be hosted into nickel-aluminate carrier for coating applications from colloidal and/or polymeric slurries.

EXAMPLE 5

An amount of 100 g of $Cr(NO_3)_3.9\ H_2O$ was heated to dissolve the salt in its own water of crystallisation to form a solution containing 19 g $Cr_2O_3$. The solution was heated to 120° C. and 12.5 g of magnesium-hydroxy carbonate containing the equivalent of 5.0 g MgO was added. Upon stirring a solution was obtained in the form of an anion-deficient polymer mixture with a density of approximately 1.5 g/cm$^3$ suitable to act as a carrier. An amount of 50 g of this carrier was evaporated to dryness to convert the solution into a fine oxide powder. The oxides were then calcined at 600° C. into a magnesium chromite powder to form a non-dispersable but suspended particulate.

After grinding to a fine powder, the magnesium chromite particulate was suspended in the polymer carrier to form a slurry suitable for coating treated metal substrates.

EXAMPLE 6

An amount of 150 g of $Fe(NO_3)_3.9\ H_2O$ was heated to dissolve the salt in its own water of crystallisation to form a solution containing 29 g $Fe_2O_3$. The solution was heated to 120° C. and 18.9 g of magnesium hydroxy-carbonate dissolved in the hot solution to form 7.5 g MgO in form of an inorganic polymer together with $Fe_2O_3$. An amount of 50 g of the polymer solution was evaporated to dryness and then calcined at 600° C. yielding approximately 13 g of magnesium ferrite powder.

After calcination, the ferrite powder was ground in a pestle and mortar and then suspended as a non-dispersable particulate in the same inorganic polymer acting as a carrier to give a slurry that was used to coat a treated metal substrate.

EXAMPLE 7

A cleaned surface of an Inconel™ billet (typically comprising 76 weight % nickel—15.5 weight % chromium—8 weight % iron) was pre-coated with a ceria colloid as described in U.S. Pat. No. 4,356,106 (Woodhead/Raw), dried and heated in air at 500° C. The pre-coated billet was then further coated with the polymeric slurry described in Example 1 or 2, dried and heated in air at 500° C. The ferrite coating was very adherent and successive layers of the slurry could be applied to build up a coating of ferrite/aluminate having a thickness above 100 micron.

A similar untreated Inconel™ billet was coated with a 10 micron thick layer using the polymeric slurry described in Example 1 or 2 but without pre-coating the billet with ceria colloid. After heat-treatment the coating was cracked and easily broke away from the substrate, which demonstrated the effect of the ceria pre-coat.

What is claimed is:

1. A method of coating an electronically conductive and heat resistant substrate of a non-carbon metal-based anode of a cell for the electrowinning of metals from their oxides dissolved in molten salt, to protect and make the surface of the anode substrate active for the oxidation of the oxygen ions present in the electrolyte, the method comprising applying onto the substrate a slurry comprising at least one oxide or a precursor thereof as a non-dispersed but suspended particulate in a colloidal and/or inorganic polymeric carrier, said slurry being solidified and made adherent to the substrate upon heat treatment to form an adherent, protective, predominantly oxide-containing coating.

2. The method of claim 1, wherein the slurry is applied to an anode for the electrowinning of aluminium by the electrolysis of alumina dissolved in a molten fluoride-containing electrolyte.

3. The method of claim 1, wherein the colloidal and/or inorganic polymeric carrier comprises at least one of alumina, ceria, lithia, magnesia, silica, thoria, yttria, zirconia, tin oxide and zinc oxide.

4. The method of claim 1, wherein the colloidal and/or inorganic polymeric carrier forms upon heat treatment the same chemical compound as the non-dispersed particulate.

5. The method of claim 1, comprising applying to the substrate spinels and/or perovskites, or precursors thereof as a non-dispersed particulate and/or as a carrier.

6. The method of claim 5, wherein said spinels are doped, non-stoichiometric and/or partially substituted spinels, the doped spinels comprising dopants selected from the group consisting of $Ti^{4+}$, $Zr^{4+}$, $Sn^{4+}$, $Fe^{4+}$, $Hf^{4+}$, $Mn^{4+}$, $Fe^{3+}$, $Ni^{3+}$, $Co^{3+}$, $Mn^{3+}$, $Al^{3+}$, $Cr^{3+}$, $Fe^{2+}$, $Ni^{2+}$, $Co^{2+}$, $Mg^{2+}$, $Mn^{2+}$, $Cu^{2+}$, $Zn^{2+}$ and $Li^{+}$.

7. The method of claim 6, wherein the spinels comprise a ferrite or a ferrite precursor.

8. The method of claim 7, wherein the coating comprises at least one ferrite selected from cobalt, copper, manganese, nickel and zinc ferrites.

9. The method of claim 8, wherein the ferrite is doped with at least one oxide selected from the group consisting of chromium, titanium, tin, zinc and zirconium oxide.

10. The method of claim 8, wherein the ferrite is nickel ferrite or nickel ferrite partially substituted with $Fe^{2+}$.

11. The method of claim 5, wherein the spinels comprise a chromite or a chromite precursor.

12. The method of claim 11, wherein the coating comprises at least one chromite selected from iron, cobalt, copper, manganese, beryllium, calcium, strontium, barium, yttrium, magnesium, nickel and zinc chromite.

13. The method of claim 1, wherein the coating comprises at least one electrocatalyst.

14. The method of claim 13, wherein the electrocatalyst(s) is/are selected from iridium, palladium, platinum, rhodium, ruthenium, silicon, tin, zinc, the Lanthanide series and Mischmetal oxides, and mixtures and compounds thereof.

15. The method of claim 1, wherein constituents of the slurry react together to form the coating.

16. The method of claim 1, wherein constituents of the slurry react with constituents of the conductive substrate to form the coating.

17. The method of claim 1, wherein the slurry is applied by brush, spraying, dipping, electrodeposition or rollers onto the substrate.

18. The method of claim 1, wherein the substrate is selected from metals, alloys, intermetallics, cermets, and conductive ceramics.

19. The method of claim 18, wherein the substrate comprises at least one metal selected from chromium, cobalt, hafnium, iron, molybdenum, nickel, copper, niobium, platinum, silicon, tantalum, titanium, tungsten, vanadium, yttrium and zirconium, and combinations and compounds thereof.

20. The method of claim 1, comprising applying the slurry onto a conductive substrate which is passivatable during electrolysis to become substantially non-conductive and inert to the electrolyte.

21. The method of claim 1, wherein the substrate is pre-coated prior to applying the slurry.

22. The method of claim 21, wherein the substrate is pre-coated with a colloidal and/or polymeric solution containing at least one oxide selected from $SiO_2$, $Al_2O_3$, $ThO_2$, $ZrO_2$, $SnO_2$, $TiO_2$ and $CeO_2$.

23. The method of claim 1 for reconditioning a coated anode, the active coating of which has become non-active or is worn, wherein the surface of the conductive substrate is cleared and restored before applying said slurry onto the substrate.

24. A slurry which is a precursor of a coating for an electronically conductive and heat resistant substrate of an anode for the electrowinning of metals from their oxides dissolved in molten salts, forming an adherent, protective, predominantly oxide-containing coating upon heat treatment and making the surface of the anode substrate active for the oxidation of the oxygen ions present in the electrolyte, the slurry comprising at least one oxide or a precursor thereof as a non-dispersed but suspended or suspendable particulate in a colloidal and/or inorganic polymeric carrier.

25. The slurry of claim 24, which is a precursor of a predominantly oxide-containing active coating for a substrate of an anode for the electrowinning of aluminium by the electrolysis of alumina dissolved in a molten fluoride-containing electrolyte.

26. The slurry of claim 24, wherein the colloidal and/or inorganic polymeric carrier comprises at least one of alumina, ceria, lithia, magnesia, silica, thoria, yttria, zirconia, tin oxide and zinc oxide.

27. The slurry of claim 24, wherein the colloidal and/or inorganic polymeric carrier forms upon heat treatment the same chemical compound as the non-dispersed particulate.

28. The slurry of claim 24, which comprises spinels and/or perovskites, or precursors thereof as a non-dispersed particulate and/or as a carrier.

29. The slurry of claim 28, wherein said spinels are doped, non-stoichiometric and/or partially substituted spinels, the doped spinels comprising dopants selected from the group consisting of $Ti^{4+}$, $Zr^{4+}$, $Sn^{4+}$, $Fe^{4+}$, $Hf^{4+}$, $Mn^{4+}$, $Fe^{3+}$, $Ni^{3+}$, $Co^{3+}$, $Mn^{3+}$, $Al^{3+}$, $Cr^{3+}$, $Fe^{2+}$, $Ni^{2+}$, $Co^{2+}$, $Mg^{2+}$, $Mn^{2+}$, $Cu^{2+}$, $Zn^{2+}$ and $Li^{+}$.

30. The slurry of claim 29, which comprises a ferrite or a ferrite precursor.

31. The slurry of claim 30, which comprises a ferrite selected from cobalt, copper, chromium, manganese, nickel and zinc ferrites, and mixtures and precursors thereof.

32. The slurry of claim 30, wherein the ferrite is doped with at least one oxide selected from the group consisting of chromium, titanium, tin, zinc and zirconium oxide.

33. The slurry of claim 31, which comprises nickel ferrite or nickel ferrite partially substituted with $Fe^{2+}$, or precursors thereof.

34. The slurry of claim 28, which comprises a chromite or a chromite precursor.

35. The slurry of claim 34, which comprises a chromite selected from iron, cobalt, copper, manganese, beryllium, calcium, strontium, barium, yttrium, magnesium, nickel and zinc chromite, and mixtures and precursors thereof.

36. The slurry of claim 24, which further comprises at least one electrocatalyst or a precursor thereof.

37. The slurry of claim 36, wherein the electrocatalyst(s) is/are selected from iridium, palladium, platinum, rhodium, ruthenium, silicon, tin, zinc, Mischmetal oxides and metals of the Lanthanide series, and mixtures and compounds thereof.

38. The slurry of claim 24, whose oxide constituents react among themselves when subjected to heat treatment.

39. The slurry of claim 24, whose constituents react with constituents of the electronically conductive and heat resistant substrate when subjected to heat treatment.

40. A conductive substrate coated with the slurry of claim 24, having coating-free areas of the surface of the substrate which become passive and substantially inert to electrolyte and non-conductive.

41. A conductive substrate coated with the slurry of claim 24, comprising a pre-coating on which the slurry coating is applied.

42. The conductive substrate of claim 41, wherein the pre-coating is an applied dried and/or heat treated colloid and/or polymer containing at least one oxide selected from $SiO_2$, $Al_2O_3$, $ThO_2$, $ZrO_2$, $SnO_2$, $TiO_2$ and $CeO_2$, and combinations thereof.

43. An anode of a cell for the electrowinning of a metal comprising an electronically conductive substrate and a protective electrochemically active coating obtained from a slurry according to claim 24.

44. The anode of claim 43, for the electrowinning of aluminium.

45. A cell for the electrowinning of a metal from its oxide dissolved in a molten salt, which comprises at least one anode according to claim 43.

46. The cell of claim 45, for the electrowinning of aluminium by the electrolysis of alumina dissolved in a fluoride-containing electrolyte.

47. The cell of claim 46, wherein the electrolyte is cryolite or cryolite-based.

48. The cell of claim 46, comprising at least one aluminium-wettable cathode.

49. The cell of claim 48, which is in a drained configuration.

50. The cell of claim 49, comprising at least one drained cathode on which aluminium is produced and from which aluminium continuously drains.

51. The cell of claim 46, which is in a bipolar configuration and wherein the anodes form the anodic side of at least one bipolar electrode and/or a terminal anode.

52. The cell of claim 46, comprising means to circulate the electrolyte between the anodes and facing cathodes and/or means to facilitate dissolution of alumina in the electrolyte.

53. The cell of claim 46, wherein during operation the electrolyte is at a temperature of 750° C. to 970° C.

54. The cell of claim 46, for the electrowinning of a lanthanide.

55. The cell of claim 54, for the electrowinning of neodymium.

56. A method of electrowinning aluminium in a cell according to claim 46, comprising dissolving alumina in said electrolyte and then electrolysing the dissolved alumina to produce aluminium.

* * * * *